US012227953B1

(12) United States Patent
Sturm

(10) Patent No.: US 12,227,953 B1
(45) Date of Patent: Feb. 18, 2025

(54) DECK BOARD SPACING TOOL

(71) Applicant: John Russell Sturm, Punta Gorda, FL (US)

(72) Inventor: John Russell Sturm, Punta Gorda, FL (US)

( * ) Notice: Subject to any disclaimer, the term of this patent is extended or adjusted under 35 U.S.C. 154(b) by 0 days.

(21) Appl. No.: 18/668,191

(22) Filed: May 19, 2024

(51) Int. Cl.
*E04F 21/20* (2006.01)

(52) U.S. Cl.
CPC ..... *E04F 21/20* (2013.01)

(58) Field of Classification Search
CPC ..... E04F 21/20
See application file for complete search history.

(56) References Cited

U.S. PATENT DOCUMENTS 3,201,874 A * 8/1965 Christy ..... E04C 3/02 D10/64
4,322,064 A * 3/1982 Jarvis ..... B25B 11/02 269/910
6,293,028 B1 * 9/2001 Sylvia ..... G01B 3/08 33/417
6,935,041 B2 * 8/2005 Orton ..... E04G 21/1891 33/613
7,152,338 B2 * 12/2006 Thompson ..... E04B 7/04 33/613
7,571,551 B1 * 8/2009 Anderson ..... E04G 21/1841 33/613
8,176,648 B2 * 5/2012 Bradley ..... E04G 21/1883 33/562
8,191,335 B2 * 6/2012 Davis ..... E04G 21/1891 33/645
2006/0196068 A1 * 9/2006 Thompson ..... E04G 21/1891 33/613
2010/0083519 A1 * 4/2010 Bradley ..... E04G 21/1841 33/613
2011/0219724 A1 * 9/2011 Davis ..... E04G 21/1891 33/354
2013/0111775 A1 * 5/2013 Davis ..... E04G 21/1891 33/613
2016/0024791 A1 * 1/2016 Reno ..... E04C 3/02 52/745.21
2016/0108626 A1 * 4/2016 Lopez ..... E04F 21/0092 33/526
2017/0138719 A1 * 5/2017 Woodruff ..... E04G 21/1891

* cited by examiner

*Primary Examiner* — Yaritza Guadalupe-McCall
(74) *Attorney, Agent, or Firm* — Gulf Coast Intellectual Property Group

(57) ABSTRACT

A board spacing tool that is configured to provide consistent spacing of boards being laid adjacent to each other in applications such as but not limited to deck and dock board installation. The invention includes an elongated body that is comprised of segments wherein the segments are releasably secured to each other. The body includes a first end and a second end wherein the body further includes a lower edge that is superposed boards during use of the board spacing tool. The lower edge has formed therein a multitude of spacing member receiving slots wherein the spacing member receiving slots have a calibrated distance therebetween same sized spacing member receiving slots. In a preferred embodiment of the invention the spacing member receiving slots are provided in three alternate sizes. Spacing members are releasably secured to the spacing member receiving slots and have a portion that extends downward from the body.

2 Claims, 2 Drawing Sheets

DECK BOARD SPACING TOOL

FIELD OF THE INVENTION

The present invention relates generally to construction tools, more specifically but not by way of limitation, a deck and dock board spacing tool wherein the present invention includes an elongated body member configured to have alternate sizes of spacers releasably secured thereto wherein the body member provides location of the spacers to ensure consistent spacing of boards during installation thereof.

BACKGROUND

As is known in the art, most deck and dock construction employs a substructure that can be comprised of elements such as but not limited to posts and support joists. The deck or dock surface is secured to the top of the substructure employing suitable fasteners such as but not limited to screws. The most commonly utilized board for deck and dock surfaces is a two by six board that is cut to the required length for the installation. These boards are placed adjacent to each other and secured to the substructure. During the installation it is critical for the boards to maintain a consistent spacing between each other.

Many times individuals will employ various article to attempt to maintain a consistent space between deck and dock boards during installation. Items such as shims and even common items such as nails are utilized to provide spacing between the deck and dock boards. The use of these types of items can lead to inconsistent spacing which can result in either inconsistent spacing or result in an issue at the end of the substructure wherein a board may have to be cut longitudinally in order to be fit which results in an undesirable appearance.

Accordingly, there is a need for a deck and dock board spacing tool wherein the tool of the present invention includes a body member that includes releasably secured spacing members wherein the spacing members provide consistent spacing between deck and dock boards and wherein the body includes receiving slots for alternate size spacing members and further ensures consistent placement thereof.

SUMMARY OF THE INVENTION

It is the object of the present invention to provide a deck and dock board installation tool that facilitates consistent spacing therebetween wherein the present invention includes an elongated body member manufactured from a rigid lightweight material such as but not limited to plastic.

Another object of the present invention is to provide a tool employed to ensure consistent spacing of deck and dock boards wherein the body is comprised of a plurality of releasably secured segments.

A further object of the present invention is to provide a deck and dock board installation tool that facilitates consistent spacing therebetween wherein the body can be provided in numerous alternate lengths.

Yet a further object of the present invention is to provide a tool employed to ensure consistent spacing of deck and dock boards wherein the body includes a lower edge wherein the lower edge includes spacing member receiving slots formed therein.

Still another object of the present invention is to provide a deck and dock board installation tool that facilitates consistent spacing therebetween wherein the spacing member receiving slots includes a starting slot formed proximate the first end of the body.

An additional object of the present invention is to provide a tool employed to ensure consistent spacing of deck and dock boards wherein the present invention further includes spacing members that are configured to be releasably secured to the spacing member receiving slots formed in the body.

Yet a further object of the present invention is to provide a deck and dock board installation tool that facilitates consistent spacing therebetween wherein the spacing members are provided in alternate thicknesses.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
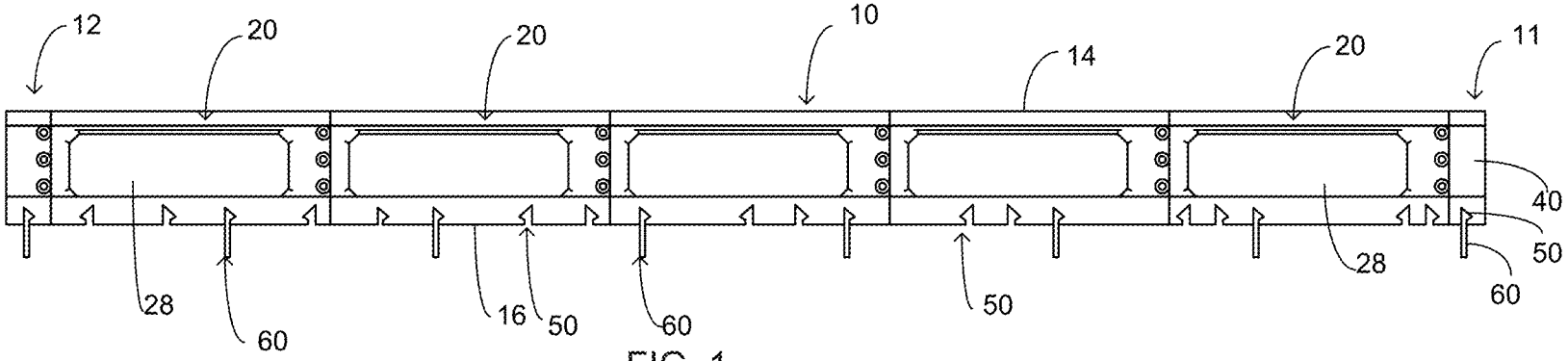
FIG. 1 is a front view of the preferred embodiment of the present invention.
Figure 2:
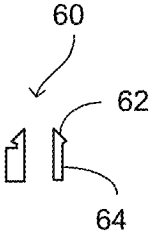
FIG. 2 is a side view of spacing members of the present invention.
Figure 3:
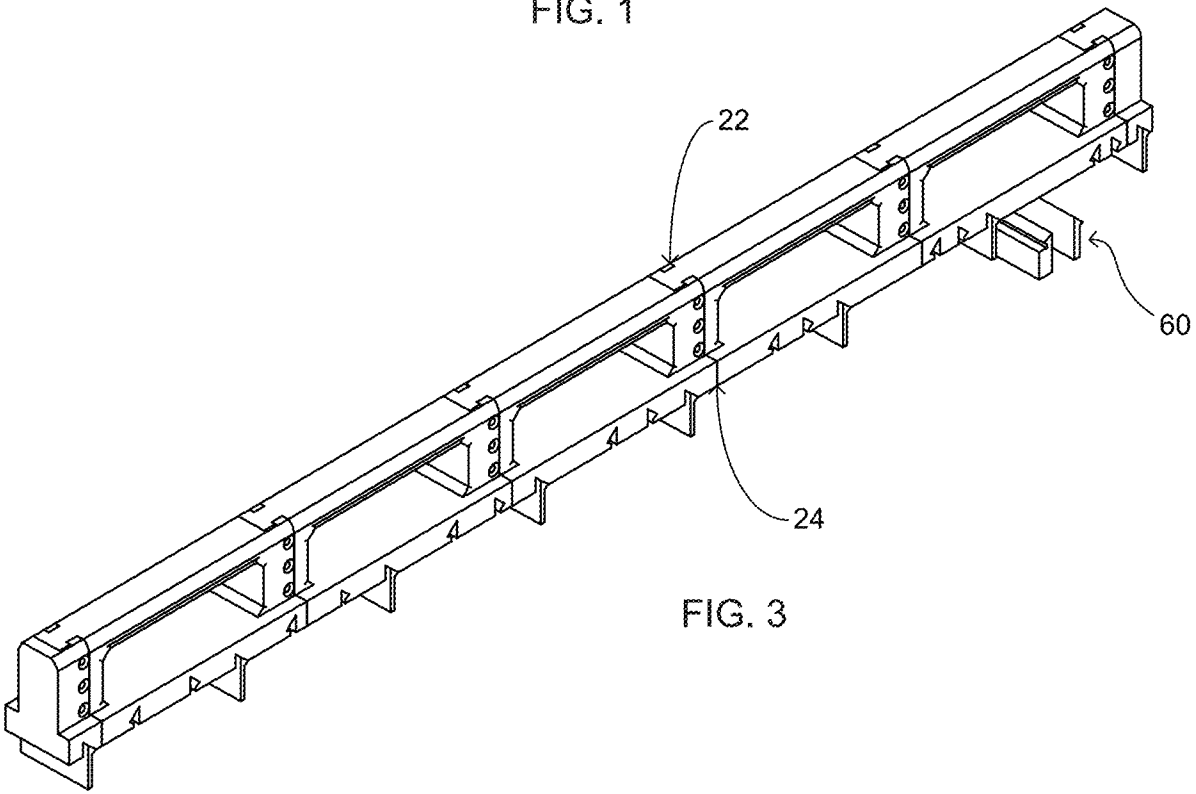
FIG. 3 is a perspective view of the present invention.
Figure 4:
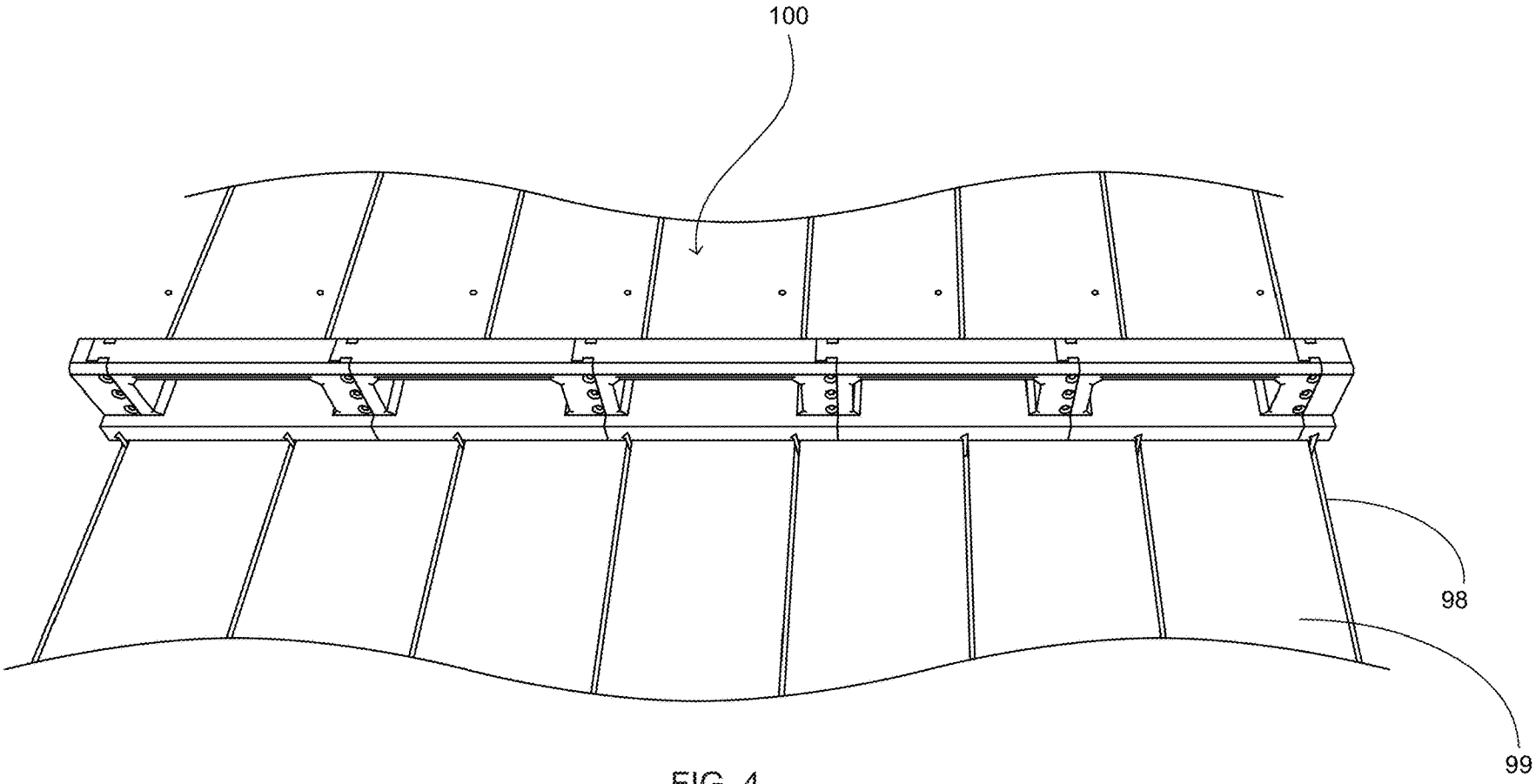
FIG. 4 is a perspective view of the present invention superposed an exemplary deck board installation.

Referring now to the drawings submitted herewith, wherein various elements depicted therein are not necessarily drawn to scale and wherein through the views and figures like elements are referenced with identical reference numerals, there is illustrated a board spacing tool 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the board spacing tool 100 is configured to be utilized to facilitate the installation of boards for applications such as but not limited to decks and docks. It should be understood within the scope of the present invention that the board spacing tool 100 could be provided in various alternate lengths and as further discussed herein is configurable in length to adapt to a particular installation. It should be further understood within the scope of the present invention that the board spacing tool 100 is manufactured employing suitable techniques utilizing materials such as but not limited to plastic or metal.

The board spacing tool 100 include a body member 10 wherein the body member 10 is elongated in form being generally rectangular in shape. The body member 10 includes a first end 11 and second end 12. Body member 10 includes an upper edge 14 and a lower edge 16. The body member 10 is comprised of a plurality of segments 20 wherein the segments 20 are releasably secured to each other. In a preferred embodiment of the board spacing tool 100 the segments 20 are releasably secured employing elements such as but not limited to tongue and groove 22 formations on the end 24 thereof. The releasable securing of the segments 20 facilitate an ability to alter the length of the body member 10 wherein the length can be made having a length of approximately two feet or could be expanded to a length of greater than ten feet. It is contemplated within the scope of the present invention that the segments 20 could be releasably coupled employing alternate elements in addition to and/or in conjunction with the tongue and groove 22 formations. By way of example but not limitation, the segments 20 could utilize magnets to facilitate releasable coupling thereof. The segments 20 include aperture 28 wherein the aperture 28 functions to reduce the weight of the segment 20 and further provide an element for grasping the body member 10 when utilizing the board spacing tool 100. It should be understood within the scope of the present invention that the aperture 28 could be provided in alternate sizes and shapes. While the preferred embodiment of the body member 10 comprises a plurality of releasably secured segments 20, it is contemplated within the scope of the present invention that the body member 10 could be provided as a single piece in a fixed length.

Releasably secured to body member 10 proximate the first end 11 thereof is starting segment 40. Starting segment 40 is secured to body member 10 employing same elements that are utilized to releasably secure adjacent segments 20. The starting segment 40 includes a spacing member receiving slot 50 that is configured to have a spacing member 60 releasably coupled thereto. In a preferred embodiment of the present invention, the starting segment 40 is installed and utilized during an application wherein a user is utilizing the board spacing tool 100 to facilitate one-eighth inch spacing between boards 99. The body member 10, in particular the segments 20 thereof, are manufactured to a length that is automatically calibrated to provide three alternate choices of spacing between boards 99. In an application wherein a user desires to space the boards 99 at a space of one-eighth inch apart, the starting segment 40 is secured to the first end 11 of the body member 10 and a one-eighth inch wide spacing member 60 is releasably secured to the spacing member receiving slot 50.

The spacing member 60 includes an upper portion 62 and a lower portion 64. Lower portion 64 of the spacing member 60 placed in the spacing member receiving slot 50 located in the starting segment 40 is placed abutted against edge 98 of board 99. The location of the additional spacing member receiving slots 50 configured to have a one-eighth spacing member releasably secured thereto are formed in the lower edge 16 of the body member 10 having a distance therebetween wherein a board 99 will be positioned so as to facilitate repetitive spacing of the desired one-eighth inch.

The lower edge 16 of the body member 10 includes a plurality of spacing member receiving slots 50 that are formed to mateably couple with the upper portion 62 of the spacing members 60. The spacing member receiving slots 50 have a space therebetween identically sized spacing member receiving slots 50 so as to facilitate calibrated spacing of boards 99 during use of the same size spacing member receiving slots 60. In a preferred embodiment of the present invention, the body member 10 includes spacing members 64 one-quarter inch and one half inch in addition to the one-eighth inch previously discussed herein. The upper portion 62 of the spacing member 60 of a particular width is formed so as to be releasably secured in only one mateable size of the spacing member receiving slots 50. By way of example but not limitation, the one-quarter inch spacing member 60 can only be releasably secured into a mateable spacing member receiving slot 50. This facilitates calibrated placement of the desired spacing members 60 so as to facilitate a uniform spacing of boards 99. The lower portion 64 of the spacing member 60 is manufactured in the desired aforementioned widths for spacing of the boards 99. The lower portion 64 extends downwards from the body member 10 so as to be adjacent an edge of the boards 99. The upper portion 62 is manufactured in a shape and size so as to only fit into a mateable spacing member receiving slot 50. While the upper portion 62 is illustrated herein as being generally triangular in shape, it is contemplated within the scope of the present invention that the upper portion 62 could be manufactured in alternate shapes so as to be releasably secured into spacing member receiving slots 50 being formed in a mateable shape.

While the preferred embodiment of the board spacing tool 100 provides three sizes of spacing members 60 configured to be releasably secured into spacing member receiving slots 50, it is contemplated within the scope of the present invention that the body member 10 could have as few as one spacing member receiving slot 50 placed at intervals along the body member 10 to provide spacing of boards 99 of only a single width. Alternatively, it is contemplated within the scope of the present invention that the body member 10 could have more than three spacing member receiving slots 50 sized to fit alternate widths of spacing members 60 wherein the spacing member receiving slots 50 configured to receive spacing members 60 of the same width have a distance therebetween that provides calibrated spacing of the boards 99.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A board spacing tool configured to provide consistent spacing between boards being installed adjacent to each other wherein the board spacing tool comprises:

a body member, said body member having a first end and a second end, said body member being elongated in form, said body member having an upper edge and a lower edge, said lower edge of said body member being placed on an upper surface of the boards, wherein the body member is comprised of a plurality of segments, said segments operable to provide alternate lengths of said body member;

a plurality of spacing member receiving slots, said spacing member receiving slots being formed in said lower edge of said body, said spacing member receiving slots being distributed along the lower edge of said body member at a calibrated distance to accommodate the boards in between adjacent spacing member receiving slots; and a plurality of spacing members, said plurality of spacing members having an upper portion and a lower portion contiguously formed, said upper portion of said spacing members being configured to be operably coupled with the spacing member receiving slots, said upper portion of said spacing members having a mateable shape to a shape of the spacing member receiving slots.

2. The board spacing tool configured to provide consistent spacing between boards being installed adjacent to each other as recited in claim 1, and further including a starting segment, said starting segment configured to be releasably coupled to the first end of said body member, said starting segment having a lower edge, said lower edge of said starting segment having an initiating spacing member receiving slot.

* * * * *